United States Patent [19]

Carbonneau

[11] 4,284,969

[45] Aug. 18, 1981

[54] POTENTIOMETER

[75] Inventor: Victor Carbonneau, Exeter, N.H.

[73] Assignee: Clarostat Mfg. Co., Inc., Dover, N.H.

[21] Appl. No.: 92,664

[22] Filed: Nov. 9, 1979

[51] Int. Cl.[3] ..... H01C 10/44

[52] U.S. Cl. ..... 338/183; 338/176

[58] Field of Search ..... 338/183, 165, 176, 180, 338/181

[56] References Cited

U.S. PATENT DOCUMENTS

| | | | |
|---|---|---|---|
| 2,273,760 | 2/1942 | Nelson | 338/183 X |
| 2,813,183 | 11/1957 | Gearheart et al. | 338/183 X |
| 2,900,615 | 8/1959 | Gottschall et al. | 338/176 |
| 2,909,750 | 10/1959 | Pitzer | 338/176 |
| 3,364,454 | 1/1968 | Froebe | 338/176 |
| 4,172,248 | 10/1979 | Okuya | 338/183 X |

*Primary Examiner*—C. L. Albritton

*Attorney, Agent, or Firm*—Kane, Dalsimer, Kane, Sullivan and Kurucz

[57] ABSTRACT

A potentiometer having in combination a non-electrical conducting substrate, a thin layer of resistance and collecting material on the substrate, a wiper movable thereon, providing communication between the resistance material and collecting material; the wiper and substrate contained in a durable housing with the wiper located on a carrier located above the substrate, supported by a shaft and rotationally fixed by a guide rail whereby axial force on the shaft casues a change in position of the wiper resulting in a change of resistance and voltage output which may be monitored.

6 Claims, 5 Drawing Figures

FIG. 1
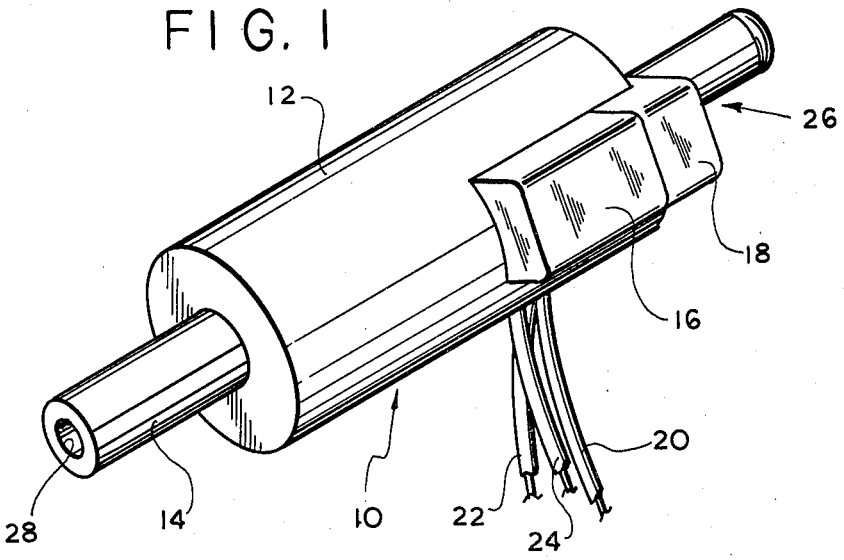
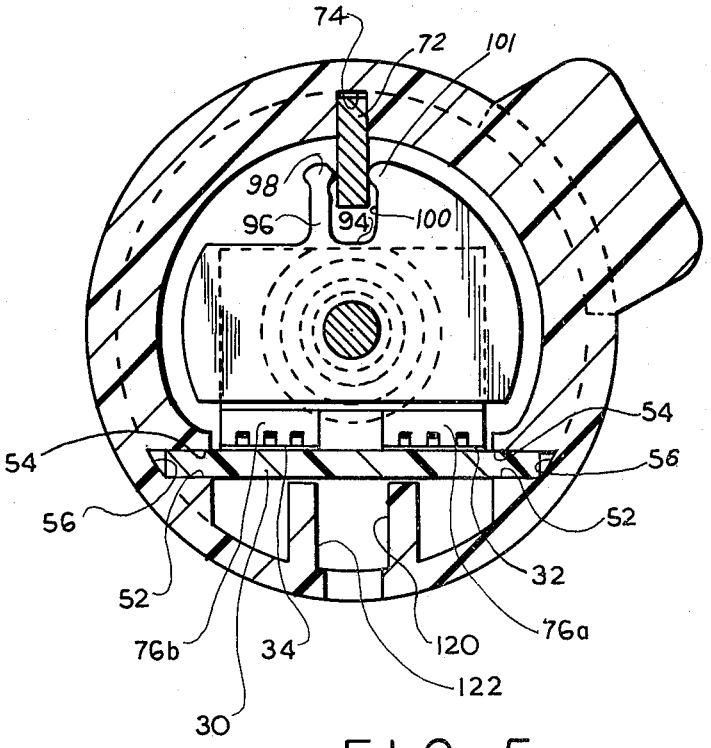
FIG. 5

POTENTIOMETER

BACKGROUND OF THE INVENTION

Potentiometers which have resistance elements along which a wiper is moved to provide a voltage output are known. Linear potentiometers are those where the voltage output varies linearly as the wiper is moved along the resistance element.

SUMMARY OF THE INVENTION

The invention relates to a structurally and functionally improved potentiometer. A typical application is in the monitoring of automobile engine conditions by connecting the device to the carburetion system. Carburetor activity would vary its output with such variations advantageously used by a microprocessor in engine regulation. However, by the very nature of such application the device is subject to severe environmental conditions. To be effective the device must be durable, withstanding the continuous application of mechanical force, in addition to the severe change in temperature and other conditions typical of under-the-hood operation.

Accordingly, it is an object of the present invention to provide a potentiometer which will include relatively few parts, with yet fewer moving parts, each individually simple in construction and capable of ready manufacture.

Another object is to provide a device small in size and inexpensive to manufacture with increased application.

A yet further object is furnishing a device of durable construction, capable of operating over a long period of time with continuous efficiency.

These and other objects are realized through the use of the potentiometer disclosed herein having in combination a non-electrical conducting substrate, a thin layer of resistance and collecting material on the substrate and a wiper providing communication between the resistance material and collector material, being movable thereon. The wiper and substrate are contained in a durable housing with the wiper located on a carrier located above the substrate, supported by a shaft and rotationally fixed by a guide rail whereby axial force on the shaft causes a change in position of the wiper resulting in a change in resistance and voltage output which may be utilized in monitoring functions.

BRIEF DESCRIPTION OF THE DRAWINGS

FIG. 1 is a perspective view of the potentiometer assembly;

FIG. 5 is a sectional view taken along lines 5—5 of the potentiometer assembly shown in FIG. 4.

DETAILED DESCRIPTION OF THE DRAWINGS

In regard to the drawings, in FIG. 1 the exposed portions of the potentiometer are shown having a housing 10 which comprises a body 12 and hub 14 attached thereto, both cylindrical in shape and a rectangular shaped block 16 extending radially outward from the body 12. The housing 10 may be integrally constructed of an inexpensive but durable material such as plastic or polyester glass, etc. which is readily moldable.

Figure 2:
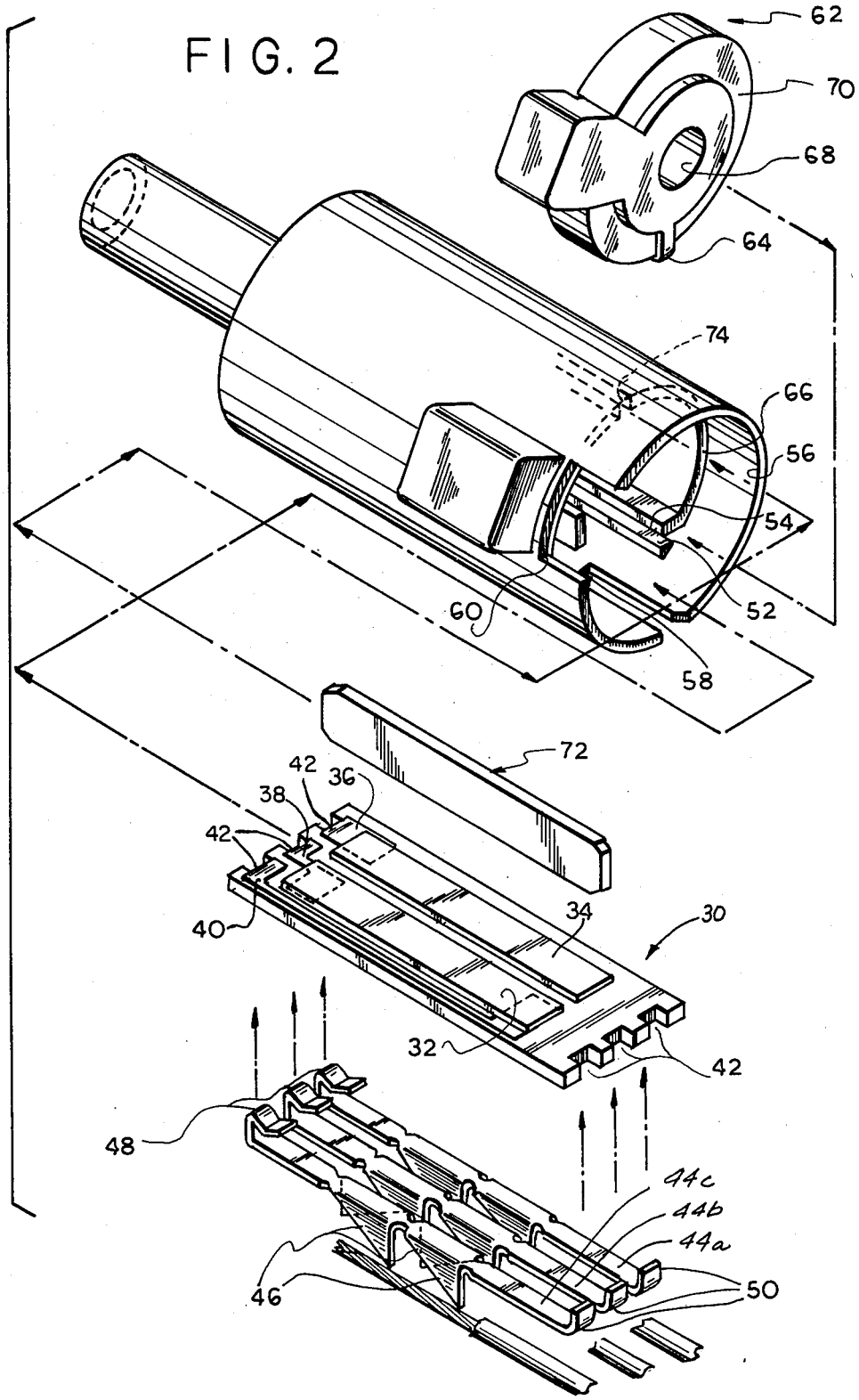
FIG. 2 is an exploded perspective view of the stationary elements of the potentiometer to disclose detailed views of the portions thereof.

As assembled, block 16 abuts a similar shaped block 18 which is located on the end cap shown in FIG. 2. While these blocks are unnecessary to the functioning of the device, they serve in one respect as a mechanism to easily prevent the rotation of the device when mounted in an installation, which could cause unnecessary stress on the lead wires 20, 22 and 24 which communicate with parts within the housing 10.

Shaft 26 projects from within body 12 at the end opposite hub 14 and is provided to receive an axial force thereon during operation of the device. The hub 14 has an axial bore 28 which provides a receptacle for a portion of the shaft 26 upon its insertion into the housing as later discussed.

With regard now to FIG. 2, the stationary elements of the potentiometer before assembly are depicted. The arrowed lines reflect the manner in which each part is joined within the housing 10. The device includes a substantially rectangular non-electrical conducting substrate 30 having a thin layer of a resistance element 32, such as a conductive plastic film, applied to the substrate surface in any desired fashion, such as for example by silk screening. Paralleling the resistant material on the substrate, and possibly similarly applied, is a thin layer of conductive material which will act as a collector 34. A number of conductors 36, 38 and 40 are also placed on the substrate by any suitable means such as etching, known printed circuit techniques utilizing copper, silver or any other commonly used material. The conductor 36 communicates with collector 34, with conductors 38 and 40 communicating with the ends of the resistance element 32.

The substrate 30 is provided with notched edges 42 located at opposite ends to facilitate communication of the wire leads with the resistance and collector elements by the use of a plurality of couplers **44*a*, 44*b* and 44*c*. The couplers should be made of a conductive material having a means of securing the wire leads thereto with a separate coupler for each lead and corresponding conductor. As shown, each coupling element has a plurality of bendable triangular shaped portions 46 which are crimped over the wire lead securely joining the same and allowing for the passage of current. A U-shaped portion 48 is located at one end of the coupler with a relative upright portion 50 located at the other end, both facilitating the fastening of the coupler to the substrate. In this regard, the U-shaped portion 48 is slid into a notch 42 partly overlapping the substrate 30, providing contact with a conductor which is positioned accordingly. At this time the upright portion 50** will be in the notch on the opposite end of the substrate and may be bent down over the same thereby preventing the coupler from being jostled out of position. By such an arrangement the resistance and collector elements are simply but securely connected to the wire lead. Of course, any other means of securely providing for terminals for the resistance and collector elements may be utilized if so desired.

The substrate 30 with the couplers 44 and wire leads 20–24 can then be inserted into the housing 10. The substrate would slide within the longitudinal slots provided within the body 12 and defined by surfaces 52, 54 and the internal surface 56 of the body. The slots are on opposite sides of the body as shown in FIG. 5.

The body 12 also has a slotted portion 58 which tapers outward at its open end, accommodating the lead wires. A second slot 60 is provided to receive block portion 18 of the end cap 62. The cap's shape and dimension correspond to the internal surface 56 of the body so that the cap fits snug when inserted therein. Also, a radially extending portion 64 upon insertion of the cap into the body, enters slot 58, which at this time contains the lead wires, and continued insertion of the cap until it abuts surface 66 and the blocks abut each other, causes the lead wires to fill the remaining slotted area providing a sealing effect against impurities. The cap may be made of the same material as the housing and is provided with an axial bore defined by surface 68 to accommodate the shaft 28 with the dimensions of the bore as such to provide minimum clearance for the shaft to inhibit entry of impurities while not inhibiting its movement. The recessed portion 70 of the cap indicates the area on which the end portion of the body 12 are molded over the cap to secure it in place.

The potentiometer is provided with a longitudinal anti-rotational or guide rail 72 which may be of a generally rectangular shape being made of durable material, possibly metal, having a smooth texture and which has a portion thereof projecting internally of body 12. The rail may be integrally constructed with the body or if separate, as shown, having tapered ends to facilitate it being press fitted into a longitudinal phantom slot 74 in the body.

The rail may also be of a different shape, such as a rod, with a portion of the wiper carrier adapted to interact with said shape so as to prevent rotation of said carrier in the housing.

Figure 3:
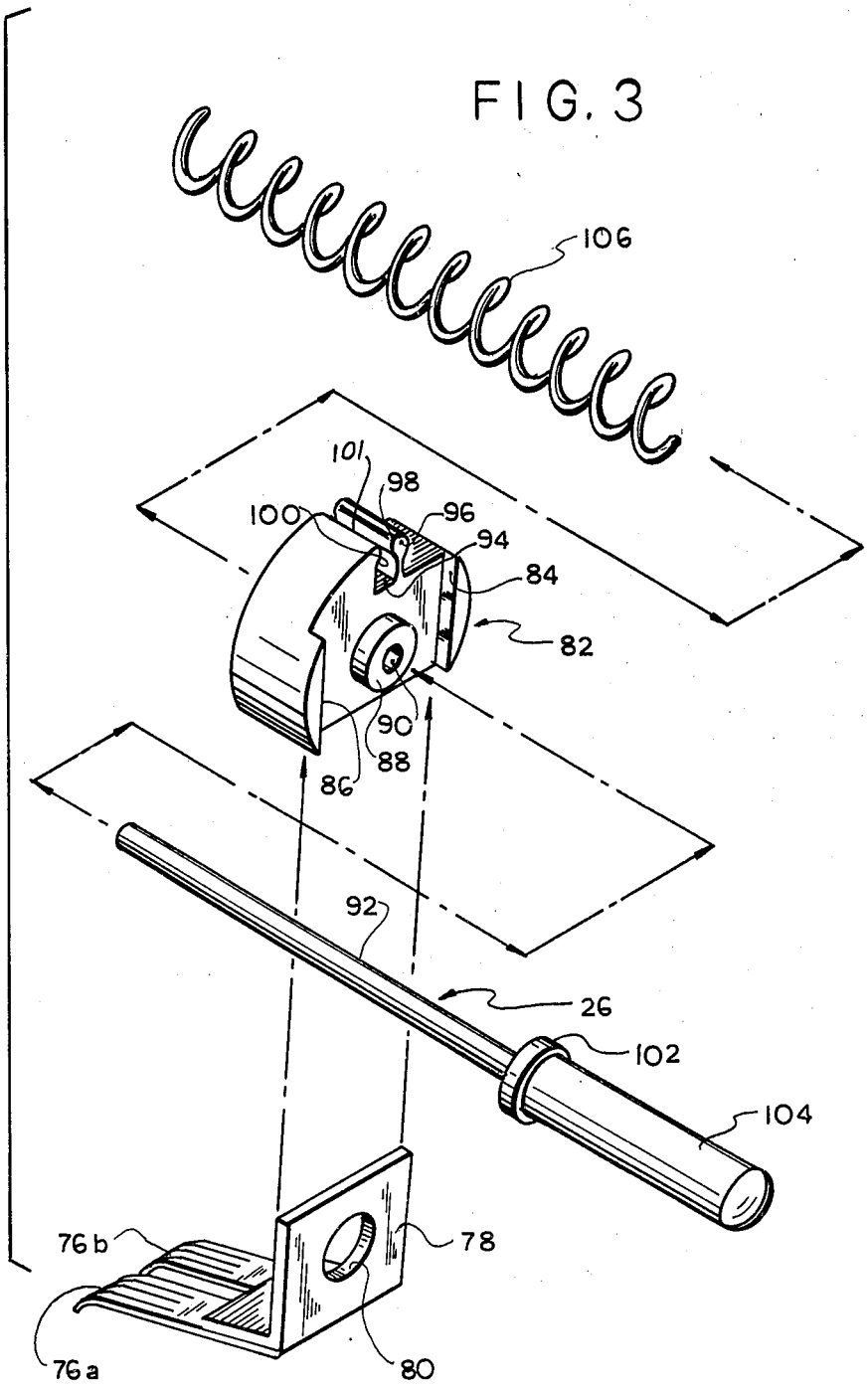
FIG. 3 is an exploded perspective view of the moving elements of the potentiometer to disclose detailed views of the portions thereof.

Moving parts of the device are depicted in FIG. 3 with the arrowed lines illustrating the mode of assembly. Contact between the resistance and the collector surfaces is provided by wiper elements 76*a* and 76*b*, each contacting a separate surface. The wipers are joined to an L-shaped member 78 having an axial bore 80. In order that a complete circuit exists between the resistance and conductor elements, the wipers and L-shaped member should be made of a conductive material with the wipers, having some resiliency, placed at a downward angle so as to insure contact with those elements.

The L-shaped member is attached to a carrier 82 positioned between surfaces 84 and 86 thereof with bore 80 encircling a raised portion 88 of the carrier which may be than pressed or heat sealed over the L-shaped member securing it fastly to the carrier. This may be readily accomplished if the carrier is made of a plastic or other moldable material.

The carrier 82 is provided with a bore defined by surface 90 which allows a portion 92 of shaft 26 to pass therethrough providing axial support for the carrier when it moves within the housing.

An important feature of the invention is the provision of the carrier which provides a receptacle for the guide rail 72. Spring portion 96 of the carrier, since it is a plastic piece, serves to spring load the carrier against the guide rail which is positioned between bead 98 of spring portion 96 and bead 101 of wall 100, preventing rotation of the carrier as shown in FIG. 5. The distance between the heads is slightly less than the width (thickness) of guide rail 72. Since wall 100 is substantially rigid and provides the reference, therefore reference is always made to bead 98 with respect to radial movement.

The shaft 26 has a lip 102 located between the internal portion 92 on which the carrier rides, and the external portion 104 which receives the axial force. The shaft is preferably integrally constructed of metal or other durable material with a smooth surface for lasting efficient operation. The lip, being larger than the bore in the carrier and that in end cap, causes the carrier to move axially with the shaft and also acts as a retaining means for the shaft. A spring or helical coil 106 is provided which, being made of a resilient material, acts as a return mechanism for the device.

Figure 4:
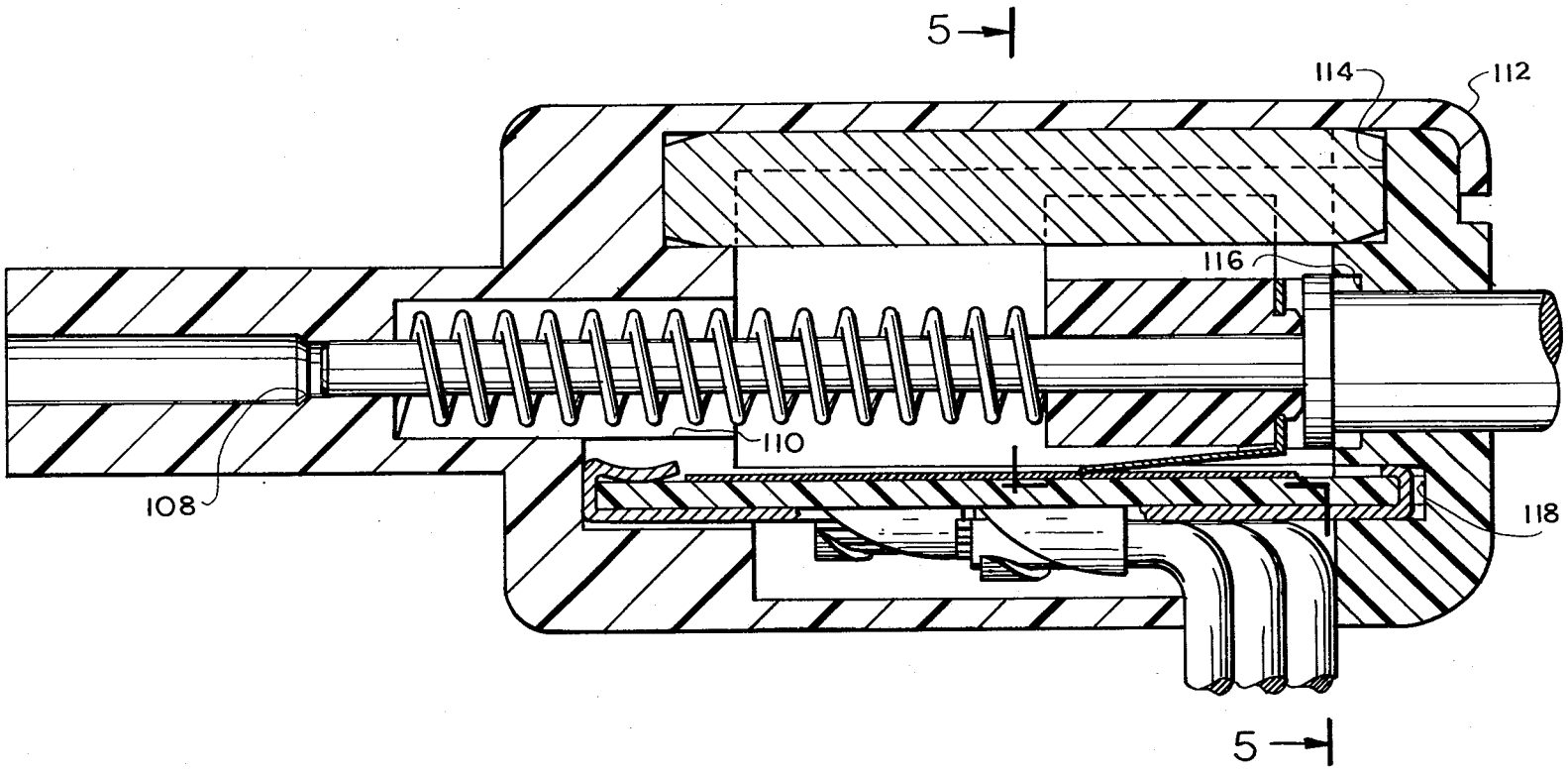
FIG. 4 is a longitudinal sectional view of the potentiometer assembly.

With regard to the assembled device as shown in FIGS. 4 and 5, the shaft is slightly depressed in the housing and is supported by the end cap and a tapered portion 108 of the bore in the hub. The tapered portion 108, in conjunction with the end cap, acts as an accurate guide for the shaft during operation and due to the minimal clearance between the surface, inhibits the entry of impurities into the housing. The remainder of the hub acts to protect the shaft when it is inserted further in the housing. If so desired, the hub might be eliminated entirely by having the body 12 similarly support the shaft.

The carrier is shown straddling the guide rail 72 with the wipers 76*a* and 76*b* in contact with the resistance and collector elements. The coil 106 is positioned between the housing and the carrier with a portion of the coil in a tapered bore 110 of the housing which allows for the feeding of the coil during assembly.

The end cap 62 is securely attached to the body by the molding over of the open end portion 112 of the body. Also, the end cap has recessed surfaces 114, 116 and 118 whose dimension correspond to the end dimensions of the guide rail, shaft lip and substrate assembly respectively, with the guide rail and substrate assembly fitting snugly therein while the lip has a somewhat loose fit. This enhances the durable nature of the device when assembled. The body may be provided with separators 120 and 122 as shown, which assist in guiding the couplers with lead wires upon insertion of the substrate in the body and insulate one from the next.

As the wipers move back and forth across the substrate a circuit will be established between the collector and the resistance element. The current conducting leads are connected to establish the desired circuit with proper potentiometer action taking place.

Although a somewhat preferred embodiment has been disclosed and described in detail herein, it should be understood that this invention is in no sense limited thereby and its scope is to be determined by that of the appended claims.

What is claimed is:

1. A potentiometer having a plurality of voltage inputs comprising in combination a housing, a non-electric conducting substrate in said housing, layers of resistance and collector material disposed on the substrate and adapted to communicate electric current, a carrier supported by a shaft, a wiper fixedly mounted on said carrier providing a circuit between the resistance material and the collector material with said wiper being responsive to an axial force placed on said carrier, a spring-means capable of exerting a force on said carrier opposite to said axial force, a guide-means which includes a rail fixedly positioned in said housing, said carrier includes a portion straddling said rail and slidably spring loaded thereagainst so that axial movement of the carrier is relatively uninhibited by the guide means while preventing the rotation of said carrier with respect to said shaft, whereby an axial force on the carrier causes the wiper to change longitudinal position on the substrate resulting in a change in voltage output with the spring-means returning the wiper to a rest position when the axial force is discontinued.

2. The invention in accordance with claim 1 wherein said rail has a smooth finish and is made of a metallic material.

3. The invention in accordance with claim 1 wherein said rail is rectangular in shape and is positioned parallel the substrate.

4. The invention in accordance with claim 1, 2 or 3 in which the carrier is integrally constructed and the portion of said carrier straddling said rail includes a slot in the carrier providing a receptacle for said rail and a first wall of said slot yieldingly urged against said rail by the resiliency thereof.

5. The invention in accordance with claim 4 in which a second wall of said slot is substantially rigid and provides a reference position with respect to radial movement.

6. The invention in accordance with claim 5 in which said rail is made of a metallic material and said first wall is made of a plastic material whereby there is minimum frictional resistance to relative movement thereof longitudinally.

* * * * *

UNITED STATES PATENT AND TRADEMARK OFFICE

CERTIFICATE OF CORRECTION

PATENT NO. : 4,284,969

DATED : August 18, 1981

INVENTOR(S) : Victor Carbonneau

It is certified that error appears in the above—identified patent and that said Letters Patent is hereby corrected as shown below:

Column 4, lines 55-56, change "inputs" to --outputs--.

Signed and Sealed this

*First* Day of *June 1982*

[SEAL]

*Attest:*

GERALD J. MOSSINGHOFF

*Attesting Officer*

*Commissioner of Patents and Trademarks*